US006457936B1

(12) United States Patent
Leach et al.

(10) Patent No.: US 6,457,936 B1
(45) Date of Patent: Oct. 1, 2002

(54) INNER SHELL RADIAL PIN GEOMETRY AND MOUNTING ARRANGEMENT

(75) Inventors: David Leach, Niskayuna; Peter Allen Bergendahl, Scotia, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/665,690

(22) Filed: Sep. 20, 2000

Related U.S. Application Data

(63) Continuation of application No. 09/313,362, filed on May 18, 1999, now abandoned.

(51) Int. Cl.[7] ..... F01D 25/26

(52) U.S. Cl. ..... 415/138; 415/139

(58) Field of Search ..... 415/136, 138, 415/139, 108, 173.1, 173.3; 403/28, 29, 30

(56) References Cited

U.S. PATENT DOCUMENTS 5,056,988 A * 10/1991 Corsmeier et al.
5,224,825 A * 7/1993 Strang et al. ..... 415/209.3
5,685,693 A * 11/1997 Sexton et al.

OTHER PUBLICATIONS

"39th GE Turbine State–of–the–Art Technology Seminar", Tab 1, ""F" Technology—the First Half–Million Operating Hours", H.E. Miller, Aug. 1996.
"39th GE Turbine State–of–the–Art Technology Seminar", Tab 2, "GE Heavy–Duty Gas Turbine Performance Characteristics", F. J. Brooks, Aug. 1996.
"39th GE Turbine State–of–the–Art Technology Seminar", Tab 3, "9EC 50Hz 170–MW Class Gas Turbine", A. S. Arrao, Aug. 1996.
"39th GE Turbine State–of–the–Art Technology Seminar", Tab 4, "MWS6001FA—An Advanced–Technology 70–MW Class 50/60 Hz Gas Turbine", Ramachandran et al., Aug. 1996.
"39th GE Turbine State–of–the–Art Technology Seminar", Tab 5, "Turbomachinery Technology Advances at Nuovo Pignone", Benvenuti et al., Aug. 1996.
"39th GE Turbine State–of–the–Art Technology Seminar", Tab 6, "GE Aeroderivative Gas Turbines—Design and Operating Features", M.W. Horner, Aug. 1996.
"39th GE Turbine State–of–the–Art Technology Seminar", Tab 7, "Advance Gas Turbine Materials and Coatings", P.W. Schilke, Aug. 1996.
"39th GE Turbine State–of–the–Art Technology Seminar", Tab 8, "Dry Low $NO_x$ Combustion Systems for GE Heavy–Duty Turbines", L. B. Davis, Aug. 1996.
"39th GE Turbine State–of–the–Art Technology Seminar", Tab 9, "GE Gas Turbine Combustion Flexibility", M. A. Davi. Aug. 1996.
"39th GE Turbine State–of–the–Art Technology Seminar", Tab 10, "Gas Fuel Clean–Up System Design Considerations for GE Heavy–Duty Gas Turbines", C. Wilkes, Aug. 1996.
"39th GE Turbine State–of–the–Art Technology Seminar", Tab 11, "Integrated Control Systems for Advanced Combined Cycles", Chu et al., Aug. 1996.

(List continued on next page.)

*Primary Examiner*—Christopher Verdier
(74) *Attorney, Agent, or Firm*—Nixon & Vanderhye

(57) ABSTRACT

Circumferentially spaced arrays of support pins are disposed through access openings in an outer turbine shell and have projections received in recesses in forward and aft sections of an inner turbine shell supported from the outer shell. The projections have arcuate sides in a circumferential direction affording line contacts with the side walls of the recesses and are spaced from end faces of the recesses, enabling radial and axial expansion and contraction of the inner shell relative to the outer shell. All loads are taken up in a tangential direction by the outer shell with the support pins taking no radial loadings.

18 Claims, 9 Drawing Sheets

OTHER PUBLICATIONS

"39th GE Turbine State–of–the–Art Technology Seminar", Tab 12, "Power Systems for the 21st Century "H" Gas Turbine Combined Cycles", Paul et al., Aug. 1996.
"39th GE Turbine State–of–the–Art Technology Seminar", Tab 13, "Clean Coal and Heavy Oil Technologies for Gas Turbines", D. M. Todd, Aug. 1996.
"39th GE Turbine State–of–the–Art Technology Seminar", Tab 14, "Gas Turbine Conversions, Modifications and Uprates Technology", Stuck et al., Aug. 1996.
"39th GE Turbine State–of–the–Art Technology Seminar", Tab 15, "Performance and Reliability Improvements for Heavy–Duty Gas Turbines,"J. R. Johnston, Aug. 1996.
"39th GE Turbine State–of–the–Art Technology Seminar", Tab 16, "Gas Turbine Repair Technology", Crimi et al, Aug. 1996.
"39th GE Turbine State–of–the–Art Technology Seminar", Tab 17, "Heavy Duty Turbine Operating & Maintenance Considerations", R. F. Hoeft, Aug. 1996.
"39th GE Turbine State–of–the–Art Technology Seminar", Tab 18, "Gas Turbine Performance Monitoring and Testing", Schmitt et al., Aug. 1996.
"39th GE Turbine State–of–the–Art Technology Seminar", Tab 19, "Monitoring Service Delivery System and Diagnostics", Madej et al., Aug. 1996.
"39th GE Turbine State–of–the–Art Technology Seminar", Tab 20, "Steam Turbines for Large Power Applications", Reinker et al., Aug. 1996.
"39th GE Turbine State–of–the–Art Technology Seminar", Tab 21, "Steam Turbines for Ultrasupercritical Power Plants", Retzlaff et al., Aug. 1996.
"39th GE Turbine State–of–the–Art Technology Seminar", Tab 22, "Steam Turbine Sustained Efficiency", P. Schofield, Aug. 1996.
"39th GE Turbine State–of–the–Art Technology Seminar", Tab 23, "Recent Advances in Steam Turbines for Industrial and Cogeneration Applications", Leger et al., Aug. 1996.
"39th GE Turbine State–of–the–Art Technology Seminar", Tab 24, "Mechanical Drive Steam Turbines", D. R. Leger, Aug. 1996.
pg,3
"39th GE Turbine State–of–the–Art Technology Seminar", Tab 25, "Steam Turbines for STAG™ Combined–Cycle Power Systems", M. Boss, Aug. 1996.
"39th GE Turbine State–of–the–Art Technology Seminar", Tab 26, "Cogeneration Application Considerations", Fisk et al., Aug. 1996.
"39th GE Turbine State–of–the–Art Technology Seminar", Tab 27, "Performance and Economic Considerations of Repowering Steam Power Plants", Stoll et al., Aug. 1996.
"39th GE Turbine State–of–the–Art Technology Seminar", Tab 28, "High–Power–Density™ Steam Turbine Design Evolution", J. H. Moore, Aug. 1996.
"39th GE Turbine State–of–the–Art Technology Seminar", Tab 29, "Advances in Steam Path Technologies", Cofer, IV, et al., Aug. 1996.
"39th GE Turbine State–of–the–Art Technology Seminar", Tab 30, "Upgradable Opportunities for Steam Turbines", D. R. Dreier, Jr., Aug. 1996.
"39th GE Turbine State–of–the–Art Technology Seminar", Tab 31, "Uprate Options for Industrial Turbines", R. C. Beck, Aug. 1996.
"39th GE Turbine State–of–the–Art Technology Seminar", Tab 32, "Thermal Performance Evaluation and Assessment of Steam Turbine Units", P. Albert, Aug. 1996.
"39th GE Turbine State–of–the–Art Technology Seminar", Tab 33, "Advances in Welding Repair Technology", J. F. Nolan, Aug. 1996.
"39th GE Turbine State–of–the–Art Technology Seminar", Tab 34, "Operation and Maintenance Strategies to Enhance Plant Profitability", MacGillivray et al., Aug. 1996.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al., Aug. 1996.
"39th GE Turbine State–of–the–Art Technology Seminar", Tab 37, "GE Combined Cycle Product Line and Performance", Chase, et al., Aug. 1996.
"39th GE Turbine State–of–the–Art Technology Seminar", Tab 38, "GE Combined Cycle Experience", Maslak et al., Aug. 1996.
"39th GE Turbine State–of–the–Art Technology Seminar", Tab 39, "Single–Shaft Combined Cycle Power Generation Systems", Tomlinson et al., Aug. 1996.
"Advanced Turbine System Program—Conceptual Design and Product Development", Annual Report, Sep. 1, 1994—Aug. 31, 1995.
"Advanced Turbine Systems (ATS Program) Conceptual Design and Product Development", Final Technical Progress Report, vol. 2– Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993—Aug. 31, 1994.
"Advanced Turbine Systems", Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document ™1753, Feb. 1998, Publication Date: Nov. 17, 1998, Report Nos. DE–FC21–95MC31176—11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.

"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.

"Gas, Steam Turbine Work as Single Unit in GE's Advanced H Technology Combined–Cycle System", Press Information, Press Release, 95–NR18, May 16, 1995, Advanced Technology Introduction/pp. 1–3.

"GE Breaks 60% Net Efficiency Barrier" paper, 4 pages.

"GE Businesses Share Technologies and Experts to Develop State–Of–The–Art Products", Press Information, Press Release 95–NR10, May 16, 1995, GE Technology Transfer/pp. 1–3.

"General Electric ATS Program Technical Review, Phase 2 Activities", T. Chance et al., pp. 1–4.

"General Electric's DOE/ATS H Gas Turbine Development", Advanced Turbine Systems Annual Review Meeting, Nov. 7–8, 1996, Washington, D.C., Publication Release.

"H Technology Commercialization", 1998 MarComm Activity Recommendation, Mar., 1998.

"H Technology", Jon Ebacher, VP, Power Gen Technology, May 8, 1998.

"H Testing Process", Jon Ebacher, VP, Power Gen Technology, May 8, 1998.

"Heavy–Duty & Aeroderivative Products" Gas Turbines, Brochure, 1998.

"MS7001H/MS9001H Gas Turbine, gepower.com website for PowerGen Europe" Jun. 1–3 going public Jun. 15, (1995).

"New Steam Cooling System is a Key to 60% Efficiency For GE "H" Technology Combined–Cycle Systems", Press Information, Press Release, 95–NRR16, May 16, 1995, H Technology/pp. 1–3.

"Overview of GE's H Gas Turbine Combined Cycle", Jul. 1, 1995 to Dec. 31, 1997.

"Power Systems for the 21$^{st}$ Century—"H" Gas Turbine Combined Cycles", Thomas C. Paul et al., Report.

"Power–Gen '96 Europe", Conference Programme, Budapest, Hungary, Jun. 26–28, 1996.

"Power–Gen International", 1998 Show Guide, Dec. 9–11, 1998, Orange County Convention Center, Orlando, Florida.

"Press Coverage following 1995 product announcement"; various newspaper clippings relating to improved generator.

"Proceedings of the Advanced Turbine Systems Annual Program Review Meeting", vol. I, "Industrial Advanced Turbine Systems Program Overview", D.W. Esbeck, pp. 3–13, Oct., 1995.

"Proceedings of the Advanced Turbine Systems Annual Program Review Meeting", vol. I, "H Gas Turbine Combined Cycle", J. Corman, pp. 14–21, Oct., 1995.

"Proceedings of the Advanced Turbine Systems Annual Program Review Meeting", vol. I, "Overview of Westinghouse's Advanced Turbine Systems Program", Bannister et al., pp. 22–30, Oct., 1995.

"Proceedings of the Advanced Turbine Systems Annual Program Review Meeting", vol. I, "Allison Engine ATS Program Technical Review", D. Mukavetz, pp. 31–42, Oct., 1995.

"Proceedings of the Advanced Turbine Systems Annual Program Review Meeting", vol. I, "Advanced Turbine Systems Program Industrial System Concept Development", S. Gates, pp. 43–63, Oct., 1995.

"Proceedings of the Advanced Turbine Systems Annual Program Review Meeting", vol. I, "Advanced Turbine System Program Phase 2 Cycle Selection", Latcovich, Jr., pp. 64–69, Oct., 1995.

"Proceedings of the Advanced Turbine Systems Annual Program Review Meeting", vol. I, "General Electric ATS Program Technical Review Phase 2 Activities", Chance et al., pp. 70–74, Oct., 1995.

"Proceedings of the Advanced Turbine Systems Annual Program Review Meeting", vol. I, "Technical Review of Westinghouse's Advanced Turbine Systems Program", Diakunchak et al., pp. 75–86, Oct., 1995.

"Proceedings of the Advanced Turbine Systems Annual Program Review Meeting", vol. I, "Advanced Combustion Turbines and Cycles: An EPRI Perspective", Touchton et al., pp. 87–88, Oct., 1995.

"Proceedings of the Advanced Turbine Systems Annual Program Review Meeting", vol. I, "Advanced Turbine Systems Annual Program Review", William E. Koop, pp. 89–92, Oct., 1995.

"Proceedings of the Advanced Turbine Systems Annual Program Review Meeting", vol. I, "The AGTSR Consortium: An Update", Fant et al., pp. 93–102, Oct., 1995.

"Proceedings of the Advanced Turbine Systems Annual Program Review Meeting", vol. I, "Overview of Allison/AGTSR Interactions", Sy A. Ali, pp. 103–106, Oct., 1995.

"Proceedings of the Advanced Turbine Systems Annual Program Review Meeting", vol. I, "Design Factors for Stable Lean Premix Combustion", Richards et al., pp. 107–113, Oct., 1995.

"Proceedings of the Advanced Turbine Systems Annual Program Review Meeting", vol. I, "Ceramic Stationary as Turbine", M. van Roode, pp. 114–147, Oct., 1995.

"Proceedings of the Advanced Turbine Systems Annual Program Review Meeting", vol. I, "DOE/Allison Ceramic Vane Effort", Wenglarz et al., pp. 148–151, Oct., 1995.

"Proceedings of the Advanced Turbine Systems Annual Program Review Meeting", vol. I, "Materials/Manufacturing Element of the Advanced Turbine Systems Program", Karnitz et al., pp. 152–160, Oct., 1995.

"Proceedings of the Advanced Turbine Systems Annual Program Review Meeting", vol. I, "Land–Based Turbine Casting Initiative", Mueller et al., pp. 161–170, Oct., 1995.

"Proceedings of the Advanced Turbine Systems Annual Program Review Meeting", vol. I, "Turbine Airfoil Manufacturing Technology", Kortovich, pp. 171–181, Oct., 1995.

"Proceedings of the Advanced Turbine Systems Annual Program Review Meeting", vol. I, "Pratt & Whitney Thermal Barrier Coatings", Bornstein et al., pp. 182–193, Oct., 1995.

"Proceedings of the Advanced Turbine Systems Annual Program Review Meeting", vol. I, "Westinhouse Thermal Barrier Coatings", Goedjen et al., pp. 194–199, Oct., 1995.

"Proceedings of the Advanced Turbine Systems Annual Program Review Meeting", vol. I, "High Performance Steam Development", Duffy et al., pp. 200–220, Oct., 1995.

"Proceedings of the Advanced Turbine Systems Annual Program Review Meeting", vol. II, "Lean Premixed Combustion Stabilized by Radiation Feedback and heterogeneous Catalysis", Dibble et al., pp. 221–232, Oct., 1995.

"Proceedings of the Advanced Turbine Systems Annual Program Review Meeting", vol. II, Rayleigh/Raman/LIF Measurements in a Turbulent Lean Premixed Combustor, Nandula et al. pp. 233–248, Oct., 1995.

"Proceedings of the Advanced Turbine Systems Annual Program Review Meeting", vol. II, "Lean Premixed Flames for Low $No_x$ Combustors", Sojka et al., pp. 249–275, Oct., 1995.

"Proceedings of the Advanced Turbine Systems Annual Program Review Meeting", vol. II, "Functionally Gradient Materials for Thermal Barrier Coatings in Advanced Gas Turbine Systems,", Banovic et al., pp. 276–280, Oct., 1995.

"Proceedings of the Advanced Turbine Systems Annual Program Review Meeting", vol. II, "Advanced Turbine Cooling, Heat Transfer, and Aerodynamic Studies", Han et al., pp. 281–309, Oct., 1995.

"Proceedings of the Advanced Turbine Systems Annual Program Review Meeting", vol. II, "Life Prediction of Advanced Materials for Gas Turbine Application", Zamrik et al., pp. 310–327, Oct., 1995.

"Proceedings of the Advanced Turbine Systems Annual Program Review Meeting", vol. II, "Advanced Combustion Technologies for Gas Turbine Power Plants", Vandsburger et al., pp. 328–352, Oct., 1995.

"Proceedings of the Advanced Turbine Systems Annual Program Review Meeting", vol. II, "Combustion Modeling in Advanced Gas Turbine Systems", Smoot et al., pp. 353–370, Oct., 1995.

"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. pp. 371–390, Oct., 1995.

"Proceedings of the Advanced Turbine Systems Annual Program Review Meeting", vol. II, "Rotational Effects on Turbine Blade Cooling", Govatzidakia et al., pp. 391–392, Oct., 1995.

"Proceedings of the Advanced Turbine Systems Annual Program Review Meeting", vol. II, "Manifold Methods for Methane Combustion", Yang et al., pp. 393–409, Oct., 1995.

"Proceedings of the Advanced Turbine Systems Annual Program Review Meeting", vol. II, "Advanced Multistage Turbine Blade Aerodynamics Performance, Cooling, and Heat Transfer", Fleeter et al., pp. 410–414, Oct., 1995.

"Proceedings of the Advanced Turbine Systems Annual Program Review Meeting, vol. II", The Role of Reactant Unmixedness, Strain Rate, and Length Scale on Premixed Combustor Performance, Samuelsen et al., pp. 415–422, Oct., 1995.

"Proceedings of the Advanced Turbine Systems Annual Program Review Meeting", vol. II, "Experimental and Computational Studies of Film Cooling With Compound Angle Injection", Goldstein et al., pp. 423–451, Oct., 1995.

"Proceedings of the Advanced Turbine Systems Annual Program Review Meeting", vol. II, "Compatibility of Gas Turbine Materials with Steam Cooling", Desai et al., pp. 452–464, Oct., 1995.

"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, pp. 465–473, Oct., 1995.

"Proceedings of the Advanced Turbine Systems Annual Program Review Meeting", vol. II, Effects of Geometry on Slot–Jet Film Cooling Performance, Hyams et al., pp. 474–496 Oct., 1995.

"Proceedings of the Advanced Turbine Systems Annual Program Review Meeting", vol. II, "Steam as Turbine Blade Coolant: Experimental Data Generation", Wilmsen et al., pp. 497–505, Oct., 1995.

"Proceedings of the Advanced Turbine Systems Annual Program Review Meeting", vol. II, "Combustion Chemical Vapor Deposited Coatings for Thermal Barrier Coating Systems", Hampikian et al., pp. 506–515, Oct., 1995.

"Proceedings of the Advanced Turbine Systems Annual Program Review Meeting", vol. II, "Premixed Burner Experiments: Geometry, Mixing, and Flame Structure Issues", Gupta et al., pp. 516–528, Oct., 1995.

"Proceedings of the Advanced Turbine Systems Annual Program Review Meeting", vol. II, "Intercooler Flow Path for Gas Turbines: CFD Design and Experiments", Agrawal et al., pp. 529–538, Oct., 1995.

"Proceedings of the Advanced Turbine Systems Annual Program Review Meeting", vol. II, "Bond Strength and Stress Measurements in Thermal Barrier Coatings", Gell et al., pp. 539–549, Oct., 1995.

"Proceedings of the Advanced Turbine Systems Annual Program Review Meeting", vol. II, "Active Control of Combustion Instabilities in Low $NO_x$ Gas Turbines", Zinn et al., pp. 550–551, Oct., 1995.

"Proceedings of the Advanced Turbine Systems Annual Program Review Meeting", vol. II, "Combustion Instability Modeling and Analysis", Santoro et al., pp. 552–559, Oct., 1995.

"Proceedings of the Advanced Turbine Systems Annual Program Review Meeting", vol. II, "Flow and Heat Transfer in Gas Turbine Disk Cavities Subject ot Nonuniform External Pressure Field", Roy et al., pp. 560–565, Oct., 1995.

"Proceedings of the Advanced Turbine Systems Annual Program Review Meeting", vol. II, "Heat Pipe Turbine Vane Cooling", Langston et al., pp. 566–572, Oct., 1995.

"Proceedings of the Advanced Turbine Systems Annual Program Review Meeting", vol. II, "Improved Modeling Techniques for Turbomachinery Flow Fields", Lakshminarayana et al., pp. 573–581, Oct., 1995.

"Proceedings of the Advanced Turbine Systems Annual Program Review Meeting", vol. II "Advanced 3D Inverse Method for Designing Turbomachine Blades", T. Dang, p. 582, Oct., 1995.

"Proceedings of the Advanced Turbine Systems Annual Program Review Meeting", "ATS and the Industries of the Future", Denise Swink, p. 1, Nov., 1996.

"Proceedings of the Advanced Turbine Systems Annual Program Review Meeting", "Gas Turbine Association Agenda", William H. Day, pp. 3–16, Nov., 1996.

"Proceedings of the Advanced Turbine Systems Annual Program Review Meeting", "Power Needs in the Chemical Industry", Keith Davidson, pp. 17–26, Nov., 1996.

"Proceedings of the Advanced Turbine Systems Annual Program Review Meeting", "Advanced Turbine Systems Program Overview", David Esbeck, pp. 27–34, Nov., 1996.

"Proceedings of the Advanced Turbine Systems Annual Program Review Meeting", "Westinghouse's Advanced Turbine Systems Program", Gerard McQuiggan, pp. 35–48, Nov., 1996.

"Proceedings of the Advanced Turbine Systems Annual Program Review Meeting", "Overview of GE's H Gas Turbine Combined Cycle", Cook et al., pp. 49–72, Nov., 1996.

"Proceedings of the Advanced Turbine Systems Annual Program Review Meeting", "Allison Advanced Simple Cycle Gas Turbine System", William D. Weisbrod, pp. 73–94, Nov., 1996.

"Proceedings of the Advanced Turbine Systems Annual Program Review Meeting", "The AGTSR Industry—University Consortium", Lawrence P. Golan, pp. 95–110, Nov., 1996.

"Proceedings of the Advanced Turbine Systems Annual Program Review Meeting", "$NO_x$ and CO Emissions Models for Gas–Fired Lean–Premixed Combustion Turbines", A. Mellor, pp. 11–122, Nov., 1996.

"Proceedings of the Advanced Turbine Systems Annual Program Review Meeting", "Methodologies for Active Mixing and Combustion Control", Uri Vandsburger, pp. 123–156, Nov., 1996.

"Proceedings of the Advanced Turbine Systems Annual Program Review Meeting", "Combustion Modeling in Advanced Gas Turbine Systems", Paul O. Hedman, pp. 157–180, Nov., 19967.

"Proceedings of the Advanced Turbine Systems Annual Program Review Meeting", "Manifold Methods for Methane Combustion", Stephen B. Pope, pp. 181–188, Nov., 1996.

"Proceedings of the Advanced Turbine Systems Annual Program Review Meeting", "The Role of Reactant Unmixedness, Strain Rate, and Length Scale on Premixed Combustor Performance", Scott Samuelsen, pp. 189–210, Nov., 1996.

"Proceedings of the Advanced Turbine Systems Annual Program Review Meeting", "Effect of Swirl and Momentum Distribution on Temperature Distribution in Premixed Flames", Ashwani K. Gupta, pp. 211–232, Nov., 1996.

"Proceedings of the Advanced Turbine Systems Annual Program Review Meeting", "Combustion Instability Studies Application to Land–Based Gas Turbine Combustors", Robert J. Santoro, pp. 233–252.

"Proceedings of the Advanced Turbine Systems Annual Program Review Meeting", Active Control of Combustion Instabilities in Low $NO_x$ Turbines, Ben T. Zinn, pp. 253–264, Nov., 1996.

"Proceedings of the Advanced Turbine Systems Annual Program Review Meeting", "Life Prediction of Advanced Materials for Gas Turbine Application," Sam Y. Zamrik, pp. 265–274, Nov., 1996.

"Proceedings of the Advanced Turbine Systems Annual Program Review Meeting", "Combustion Chemical Vapor Deposited Coatings for Thermal Barrier Coating Systems", W. Brent Carter, pp. 275–290, Nov., 1996.

"Proceedings of the Advanced Turbine Systems Annual Program Review Meeting", "Compatibility of Gas Turbine Materials with Steam Cooling", Vimal Desai, pp. 291–314, Nov., 1996.

"Proceedings of the Advanced Turbine Systems Annual Program Review Meeting", "Bond Strength and Stress Measurements in Thermal Barrier Coatings", Maurice Gell, pp. 315–334, Nov., 1996.

"Proceedings of the Advanced Turbine Systems Annual Program Review Meeting", "Advanced Multistage Turbine Blade Aerodynamics, Performance, Cooling and Heat Transfer", Sanford Fleeter, pp. 335–356, Nov., 1996.

"Proceedings of the Advanced Turbine Systems Annual Program Review Meeting", "Flow Characteristics of an Intercooler System for Power Generating Gas Turbines", Ajay K. Agrawal, pp. 357–370, Nov., 1996.

"Proceedings of the Advanced Turbine Systems Annual Program Review Meeting", "Improved Modeling Techniques for Turbomachinery Flow Fields", B. Lakshiminarayana, pp. 371–392, Nov., 1996.

"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, pp. 393–406, Nov., 1996.

"Proceedings of the Advanced Turbine Systems Annual Program Review Meeting", "Advanced Turbine Cooling, Heat Transfer, and Aerodynamic Studies", Je–Chin Han, pp. 407–426, Nov., 1996.

"Proceedings of the Advanced Turbine Systems Annual Program Review Meeting", "Heat Transfer in a Two–Pass Internally Ribbed Turbine Blade Coolant Channel with Vortex Generators", S. Acharya, pp. 427–446.

"Proceedings of the Advanced Turbine Systems Annual Program Review Meeting", "Experimental and Computational Studies of Film Cooling with Compound Angle Injection", R. Goldstein, pp. 447–460, Nov., 1996.

"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, pp. 461–470, Nov., 1996.

"Proceedings of the Advanced Turbine Systems Annual Program Review Meeting", "Steam as a Turbine Blade Coolant: External Side Heat Transfer", Abraham Engeda, pp. 471–482, Nov., 1996.

"Proceedings of the Advanced Turbine Systems Annual Program Review Meeting", "Flow and Heat Transfer in Gas Turbine Disk Cavities Subject to Nonuniform External Pressure Field", Ramendra Roy, pp. 483–498, Nov., 1996.

"Proceedings of the Advanced Turbine Systems Annual Program Review Meeting", "Closed–Loop Mist/Steam Cooling for Advanced Turbine Systems", Ting Wang, pp. 499–512, Nov., 1996.

"Proceedings of the Advanced Turbine Systems Annual Program Review Meeting", "Heat Pipe Turbine Vane Cooling", Langston et al., pp. 513–534, Nov., 1996.

"Proceedings of the Advanced Turbine Systems Annual Program Review Meeting", "EPRI's Combustion Turbine Program: Status and Future Directions", Arthur Cohn, pp. 535,–552 Nov., 1996.

"Proceedings of the Advanced Turbine Systems Annual Program Review Meeting", "ATS Materials Support", Michael Karnitz, pp. 553–576, Nov., 1996.

"Proceedings of the Advanced Turbine Systems Annual Program Review Meeting", "Land Based Turbine Casting Initiative", Boyd A. Mueller, pp. 577–592, Nov., 1996.

"Proceedings of the Advanced Turbine Systems Annual Program Review Meeting", "Turbine Airfoil Manufacturing Technology", Charles S. Kortovich, pp. 593–622, Nov., 1996.

"Proceedings of the Advanced Turbine Systems Annual Program Review Meeting", "Hot Corrosion Testing of TBS's", Norman Bornstein, pp. 623–631, Nov., 1996.
"Proceedings of the Advanced Turbine Systems Annual Program Review Meeting", "Ceramic Stationary Gas Turbine", Mark van Roode, pp. 633–658, Nov., 1996.
"Proceedings of the Advanced Turbine Systems Annual Program Review Meeting", "Western European Status of Ceramics for Gas Turbines", Tibor Bornemisza, pp. 659–670, Nov., 1996.
"Proceedings of the Advanced Turbine Systems Annual Program Review Meeting", "Status of Ceramic Gas Turbines in Russia", Mark van Roode, p. 671, Nov., 1996.
"Status Report: The U.S. Department of Energy's Advanced Turbine systems Program", facsimile dated Nov. 7, 1996.
"Testing Program Results Validate GE's H Gas Turbine—High Efficiency, Low Cost of Electricity and Low Emissions", Roger Schonewald and Patrick Marolda, (no date available).
"Testing Program Results Validate GE's H Gas Turbine—High Efficiency, Low Cost of Electricity and Low Emissions", Slide Presentation—working draft, (no date available).
"The Next Step In H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1—Dec. 31, 1996, Publication Date, Jun. 1, 1997, Report Nos.: DOE/MC/31176—5628.
"Utility Advanced Turbine System (ATS) Technology Readiness Testing—Phase 3", Document #666274, Oct. 1, 1996—Sept. 30, 1997, Publication Date, Dec. 31, 1997, Report Nos: DOE/MC31176—10.
"Utility Advanced Turbine System (ATS) Technology Readiness Testing and Pre–Commercial Demonstration, Phase 3", Document #486029, Oct. 1—Dec. 31, 1995, Publication Date, May 1, 1997, Report Nos.: DOE/MC/31176—5340.
"Utility Advanced Turbine System (ATS) Technology Readiness Testing and Pre–Commercial Demonstration—Phase 3", Document #486132, Apr. 1—Jun. 30, 1976, Publication Date, Dec. 31, 1996, Report Nos.: DOE/MC/31176—5660.
"Utility Advanced Turbine System (ATS) Technology Readiness Testing and Pre–Commercial Demonstration—Phase 3", Document #587906, Jul. 1—Sep. 30, 1995, Publication Date, Dec. 31, 1995, Report Nos.: DOE/MC/31176—5339.
"Utility Advanced Turbine System (ATS) Technology Readiness Testing and Pre–Commercial Demonstration" Document #666277, Apr. 1—Jun. 30, 1997, Publication Date, Dec. 31, 1997, Report Nos.: DOE/MC/31176—8.

"Utility Advanced Turbine System (ATS) Technology Readiness Testing and Pre–Commercialization Demonstration" Jan. 1—Mar. 31, 1996, DOE/MC/31176—5338.

"Utility Advanced Turbine System (ATS) Technology Readiness Testing: Phase 3R", Document #756552, Apr. 1—Jun. 30, 1999, Publication Date, Sep. 1, 1999, Report Nos.: DE—FC21–95MC31176–23.

"Utility Advanced Turbine System (ATS) Technology Readiness Testing.", #656823, Jan. 1—Mar. 31, 1998, Publication Date, Aug. 1, 1998, Report Nos.: DOE/MC/31176–17.

"Utility Advanced Turbine Systems (ATS) Technology Readiness Testing and Pre–Commercial Demonstration", Annual Technical Progress Report, Reporting Period: Jul. 1, 1995–Sep. 30, 1996.

"Utility Advanced Turbine Systems (ATS) Technology Readiness Testing", Phase 3R, Annual Technical Progress Report, Reporting Period: Oct. 1, 1997—Sep. 30, 1998.

"Utility Advanced Turbine Systems (ATS) Technology Readiness Testing", Document #750405, Oct. 1—Dec. 30, 1998, Publication Date: May, 1, 1999, Report Nos.: DE–FC21–95MC31176–20.

"Utility Advanced Turbine Systems (ATS) Technology Readiness Testing", Document #1348, Apr. 1—Jun. 29, 1998, Publication Date Oct. 29, 1998, Report Nos. DE–FC21–95MC31176—18.

"Utility Advanced Turbine Systems (ATS) Technology Readiness Testing—Phase 3", Annual Technical Progress Report, Reporting Period: Oct. 1, 1996—Sep. 30, 1997.

"Utility Advanced Turbine Systems (ATS) Technology Readiness Testing and Pre–Commercial Demonstration", Quarterly Report, Jan. 1—Mar. 31, 1997, Document #666275, Report Nos.: DOE/MC/31176–07.

"Proceedings of the 1997 Advanced Turbine Systems", Annual Program Review Meeting, Oct. 28–29, 1997.

* cited by examiner

INNER SHELL RADIAL PIN GEOMETRY AND MOUNTING ARRANGEMENT

This is a continuation of application Ser. No. 09/313,362, filed May 18, 1999, now abandoned, the entire content of which is hereby incorporated by reference in this application.

This invention was made with Government support under Contract No. DE-FC21-95MC31176 awarded by the Department of Energy. The Government has certain rights in this invention.

TECHNICAL FIELD

The present invention relates generally to turbines and particularly to land-based industrial turbines for generation of electricity. More particularly, the present invention relates to a gas turbine having inner and outer turbine shells and support pins between the shells for securing the shells to one another while enabling thermal expansion and contraction in radial and axial directions.

BACKGROUND OF THE INVENTION

In prior U.S. Pat. No. 5,685,693 of common assignee herewith, there is illustrated an industrial gas turbine having inner and outer shells. The inner shell has a pair of axially spaced circumferential arrays of radially outwardly projecting pins terminating in reduced sections having flats on opposite circumferential sides thereof. Generally cylindrical sleeves project inwardly and about access openings in the outer shell and have threaded bolt holes extending in circumferential directions. Bolts extend through the holes to engage the flats on the sides of the pins. By adjusting the bolts, the inner shell is adjustable externally of the outer shell to locate the inner shell about the rotor axis. Reference is made to that patent for a further, more detailed description of the inner shell/outer shell mounting arrangement. There has, however, developed a need for a more advanced mounting arrangement between the inner and outer shells in an advanced gas turbine design of assignee.

BRIEF SUMMARY OF THE INVENTION

In accordance with a preferred embodiment of the present invention, axially spaced forward and aft arrays of circumferentially spaced support pins secure the inner shell to the outer shell of the turbine in a manner which supports the inner shell against radial and circumferential movement relative to the outer shell and enables thermal expansion and contraction of the inner shell relative to the outer shell in radial and axial directions. The support pins are loaded only in circumferential or tangential directions and do not carry loads in radial or axial directions. Moreover, the weight of the inner shell is likewise carried in a circumferential direction. To accomplish the foregoing and obtain other benefits and advantages, and in a preferred embodiment, the present invention provides support pins each comprised of a cylindrical head containing a bolt circle, a generally cylindrical shank and a reduced radially inwardly extending projection for engaging the inner shell. The support pins for the forward and aft portions of the inner shell are substantially similar in configuration to one another. Each projection of each support pin has opposite sides facing in opposite circumferential directions. The sides are arcuate about axes extending generally parallel to the rotor axis. The projection is also rectilinear in radial cross-section and has flat opposite end faces in the fore and aft directions.

Preferably, a pair of axially spaced arrays of circumferentially spaced recesses are provided about forward and aft portions of the inner shell. The recesses are rectilinear and open radially outwardly of the shell. The support pins are bolted to the outer shell and are received through access openings in the outer shell. The inner projections are received in the recesses. The arcuate side faces of each projection forms a line contact with circumferentially facing side walls of the recesses. The opposed axial end faces of the projection, however, are spaced from the end walls of the recesses, enabling axial movement of the inner shell to accommodate thermal expansion and contraction.

The recesses in the rim of the inner shell comprise rectilinear through-openings formed in bushings. The bushings are circular and are received in circular openings formed in the inner shell. These rectilinear recesses are preferably formed in the bushings by an EDM process. This facilitates manufacture of the inner shell.

In a preferred embodiment according to the present invention, there is provided a turbine comprising an outer structural shell, an inner shell connected to and surrounded by the outer shell in generally concentric relation therewith, the inner shell carrying nozzles and shrouds for a turbine stage, the shrouds surrounding tips of buckets carried by a turbine rotor within the inner shell, a plurality of connecting elements engaging between the inner and outer shells aligning the inner shell about the rotor, the connecting elements engaging the inner shell with a clearance in an axial direction of the rotor to enable differential growth of the inner shell relative to the outer shell in an axial direction while maintaining concentricity of the inner shell about the rotor.

In a further preferred embodiment according to the present invention, there is provided a turbine comprising an outer structural shell, an inner shell connected to and surrounded by the outer shell in generally concentric relation therewith, the inner shell carrying nozzles and shrouds for a turbine stage, the shrouds surrounding tips of buckets carried by an axially extending turbine rotor within the inner shell, a plurality of connecting elements engaging between the inner and outer shells aligning the inner shell about the rotor, each of the connecting elements including a radial inward projection, the inner shell having a plurality of recesses spaced circumferentially thereabout receiving the projections of the connecting elements.

DETAILED DESCRIPTION OF THE INVENTION

Figure 1:
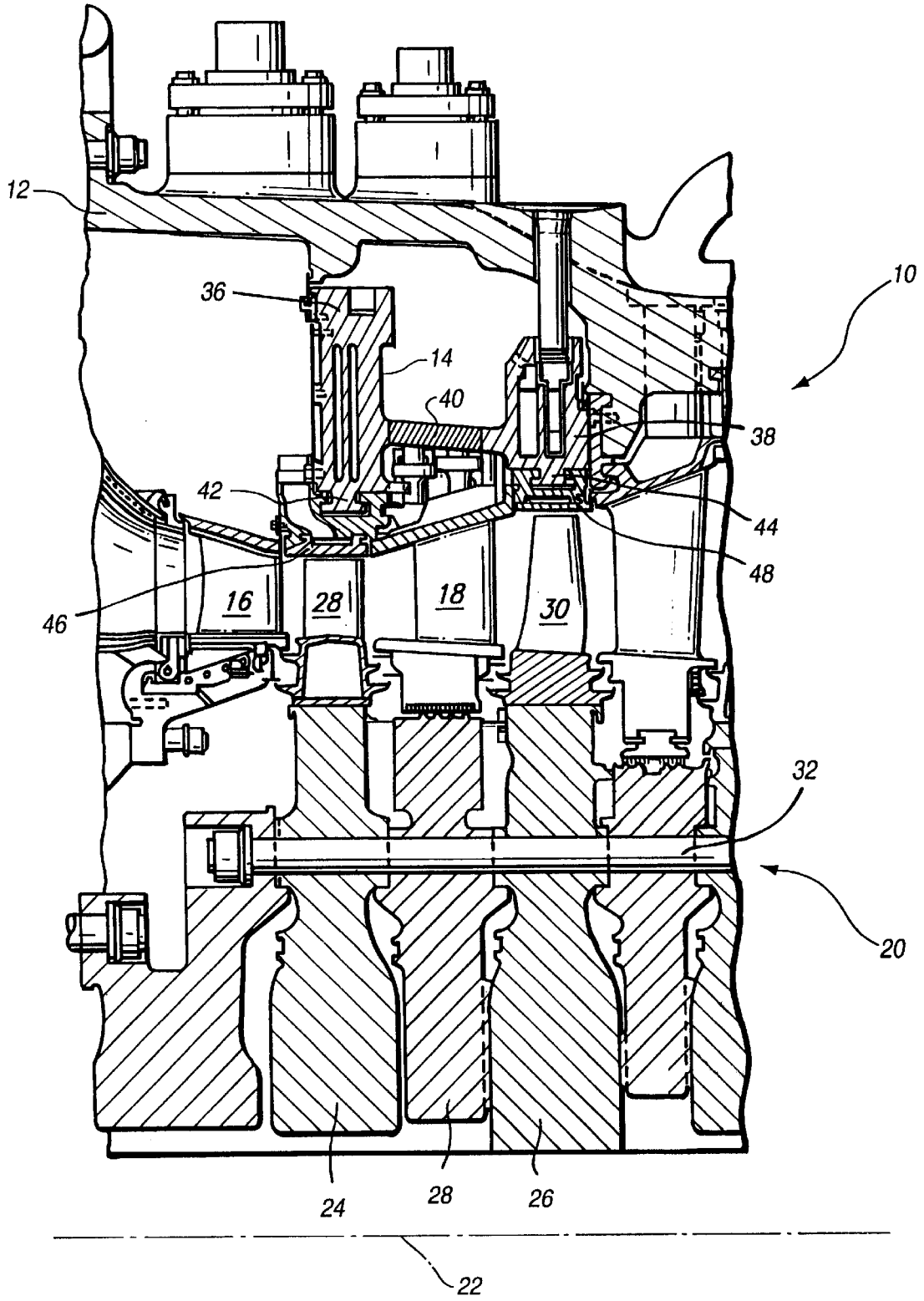
FIG. 1 is a fragmentary cross-sectional view of a portion of a section of a turbine incorporating a radial pin geometry according to the present invention.

Referring to FIG. 1, there is illustrated a turbine section, generally designated 10, of a turbine having an outer structural shell 12 and an inner shell 14 supported by the outer shell 12. The inner shell 14 carries an array of nozzles 16 and 18 forming parts of first and second stages, respectively, of the turbine. The inner shell 14 also surrounds a rotor, generally designated 20, rotatable about an axis 22. The rotor 20 includes circumferential arrays of buckets mounted on wheels arranged alternately with spacers, the wheels and spacers forming the body of the rotor. For example, the first and second-stage wheels 24 and 26 with an intervening spacer 28 are illustrated, the wheels 24 and 26 mounting buckets 28 and 30, respectively. It will be appreciated that the buckets and the nozzles of the various stages in part define the annular hot gas path through the turbine. The wheels and spacers of the rotor are secured to one another by bolts 32 circumferentially spaced one from the other about the rotor.

Figure 2:
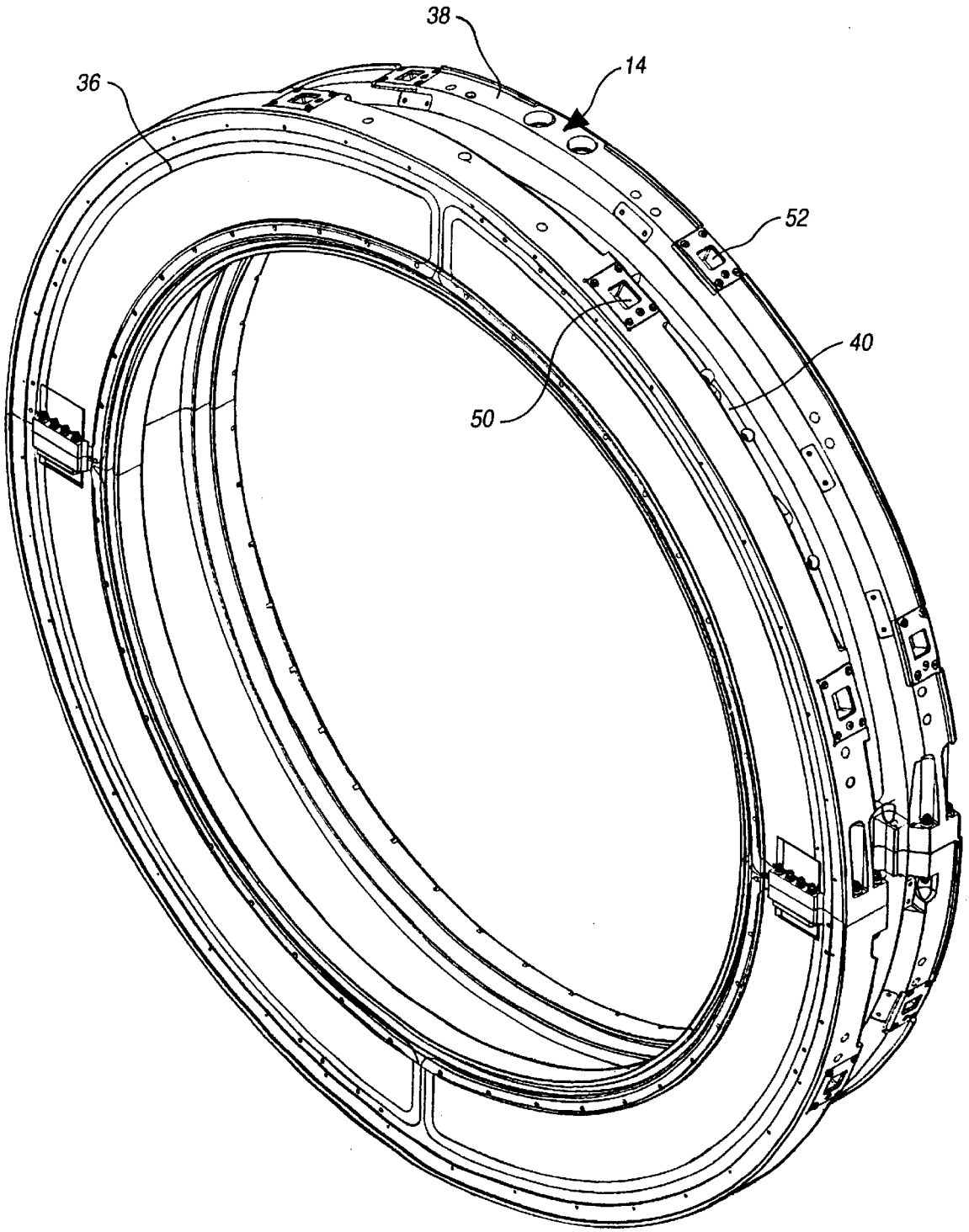
FIG. 2 is a perspective view of an inner shell with the nozzles and shrouds not shown for clarity.

Referring to FIGS. 1 and 2, the inner shell 14 comprises a forward section 36 and an aft section 38 interconnected by an axially extending annular rib 40. The forward and aft sections 36 and 38 are annular and have radially inwardly directed dovetails 42 and 44, respectively, for carrying shrouds 46 and 48. The shrouds provide a minimum clearance with the tips of the buckets. It will be appreciated that the inner shell 14 is secured to the outer shell along radial planes normal to the axis of the rotor and at axial locations, preferably in alignment with the first and second-stage buckets and shrouds.

Figure 3:
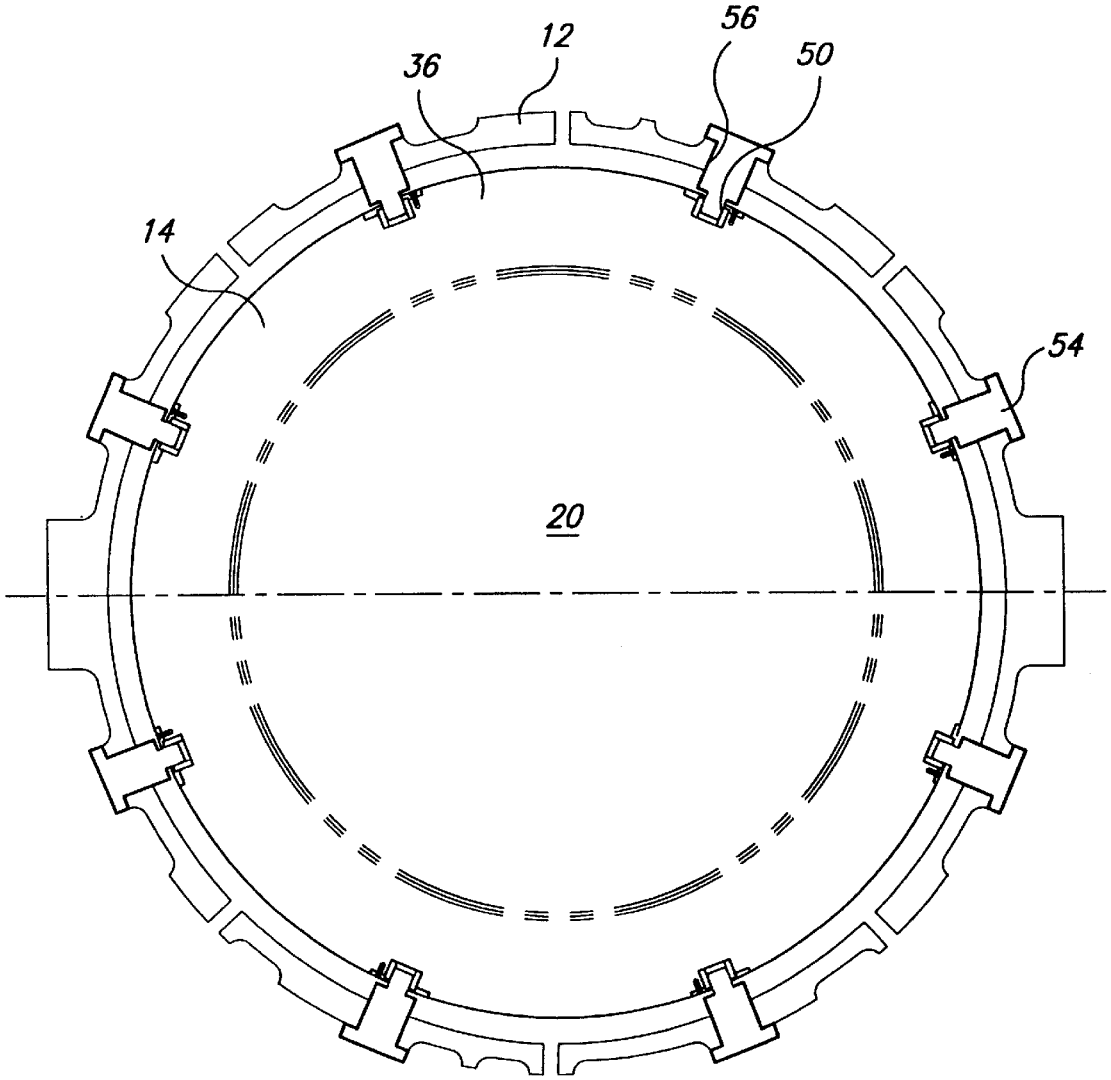
FIG. 3 is an axial schematic end view illustrating the connection between the inner and outer shells.

To connect the inner and outer shells to one another, each of the forward and aft sections 36 and 38, respectively, of the inner shell 14 are provided with circumferentially spaced recesses 50 and 52. As illustrated in FIG. 3, connecting elements, e.g., support pins 54 pass through access openings 56 through the outer shell for connection with the forward section 36 of inner shell 14. Similar pins interconnect the outer shell 12 with the aft section 38 of inner shell 14. Preferably, the pins lie at eight pin locations in each radial plane and are spaced approximately 45° one from the other about the rotor axis. The support pins 54 are also spaced from the horizontal splitline of the inner shell.

Referring to FIGS. 5–8, the support pins 54 include an enlarged head 60 having a bolt circle 62 (FIG. 5) with a purality of bolt openings 63, a generally cylindrical shank 64 and a reduced projection 66 on the radial innermost end of the support pin. Each of the opposite circumferentially facing sides 68 of the projections 66 has an arcuate surface. The arcuate surface of each side 68 is a portion of a cylindrical surface about an axis extending generally parallel to the axis of the rotor. Thus, the sides 68 face in a tangential direction. The forward and aft end faces 70 of the projection 66 face in axial opposite directions and are flat.

Figure 9:
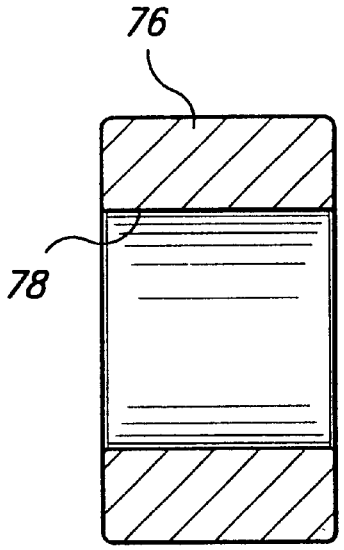
FIG. 9 is a cross-sectional view of a bushing employed in a recess of the inner shell.
Figure 10:
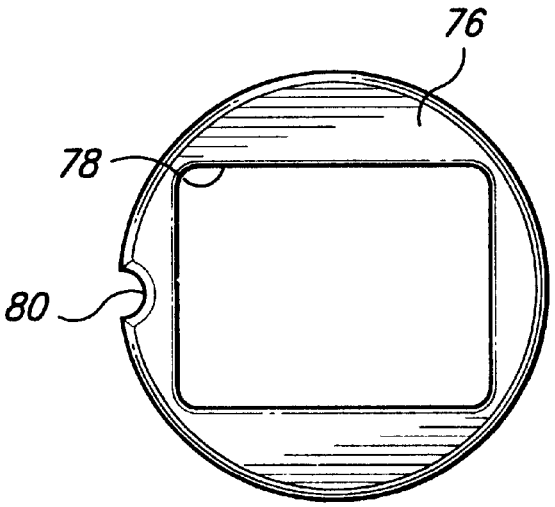
FIG. 10 is an end elevational view thereof.
Figure 11:
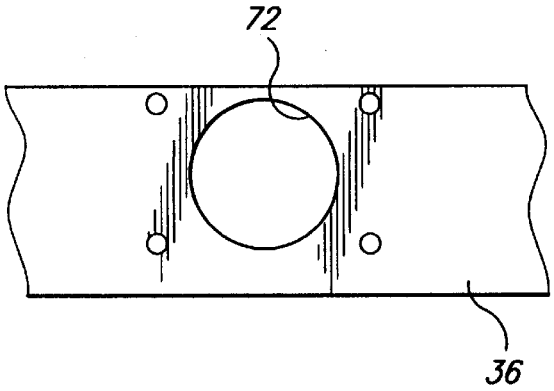
FIG. 11 is a fragmentary view looking radially inwardly into an opening of the inner shell.
Figure 12:
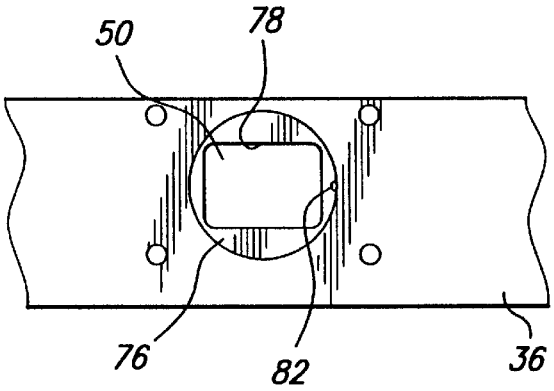
FIG. 12 is a view similar to FIG. 11 illustrating the bushing in the opening.
Figure 13:
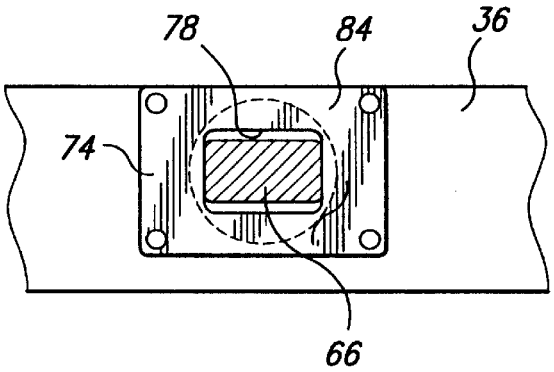
FIG. 13 is a view similar to FIG. 11 illustrating a closure plate overlying the bushing in the opening of the inner shell.

To form the recesses 50 and 52 in the inner shell 14, there is illustrated in FIG. 11 in a preferred embodiment hereof a circular aperture disposed at spaced circumferential locations about each of the forward and aft sections of the inner shell on centerlines coincident with the centerlines of the recesses 50 and 52, respectively. Only one such forward or aft section of the inner shell is illustrated, e.g., the forward section 36, the apertures 72 being cut into the rims. Circular cast bushings 76 (FIGS. 9 and 10) are inserted into the circular apertures 72 (FIG. 12). Each cast bushing 76 has a rectilinear opening 78 therethrough forming the major portion of the recess 50 into which the projections 66 of the support pins are received. The rectilinear openings 78 of the bushings 76 are preferably formed by an EDM process but other processes may be used. The long sides of the rectilinear openings in the bushings face axially, while the short sides face tangentially. To accommodate and ensure this orientation, the bushings 76 are keyed into the aperture 72, for example, by a recess 80 (FIG. 10) and a complementary projection 82 (FIG. 12) formed along the arcuate surface of the bushing and the inside surface of aperture 72. To complete each recess, a cover plate 84 (FIG. 13) having a corresponding rectilinear opening as said bushing overlies each bushing 76 and aperture 72.

Figure 4:
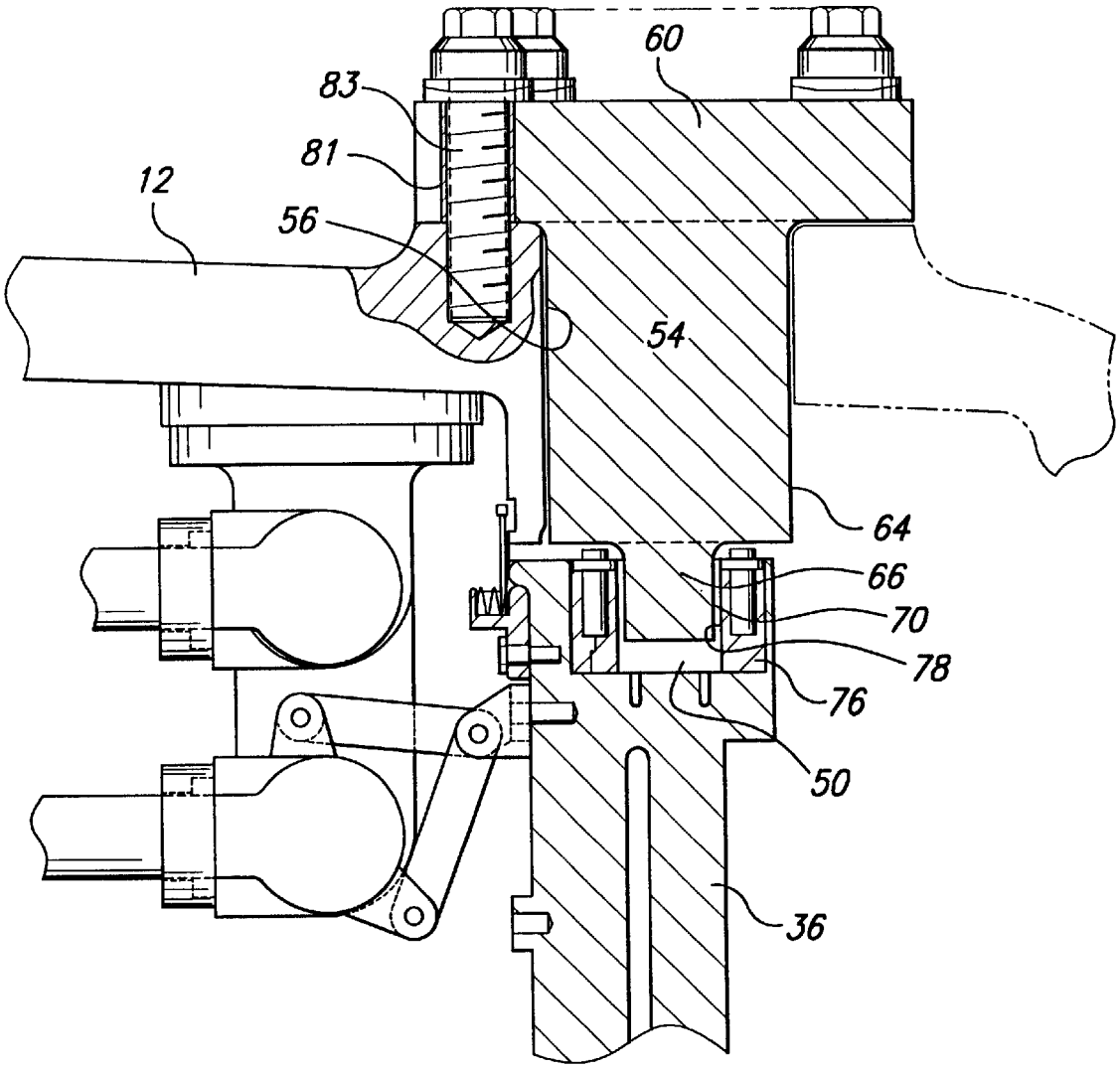
FIG. 4 is an enlarged fragmentary cross-sectional view of one of the forward support pins interconnecting the outer shell and the inner shell.

From a review of FIG. 4, it will be appreciated that the support pins 54 are inserted through the access openings of the outer shell and received within the recesses 50 or 52 as applicable, the forward section 36 and one of recesses 50 being illustrated. The arcuate sides 68 of the projections 66 at the radially inner ends of the support pins bear in line contact along the short sides of the rectilinear opening 78 in the bushing 76. The line contact extends in an axial direction. Thus, it will be appreciated that a closely toleranced fit is provided between the arcuate sides 68 of the projections and the side walls of the rectilinear openings of the bushings. The end faces 70 of each projection 66 are spaced axially from the long axially registering faces of the rectilinear opening 78 of bushing 76. Thus, a substantial clearance is provided in opposite axial directions between the projection of the support pin and the end faces of the rectilinear opening of the bushing. The clearances between the projections 66 of the aft support pins and the end faces of the rectilinear openings in the bushings in the aft portion of the inner shell may be less than the corresponding clearances between the projections and the openings of the forward inner shell portion. The clearances in the axial direction are provided to accommodate axial expansion and contraction of the inner shell relative to the outer shell. Consequently, by providing the axial clearance between the projections and the walls of the bushing openings and with the aft face of the inner shell butting a forward face of the stage 3 nozzle hangar, the magnitude of the axial expansion or contraction will be greater the further forward the inner shell lies from its abutment with the axial facing of the flat surface of the third-stage nozzle hangar.

It will be appreciated that the foregoing arrangement of the support pins enables the inner shell to thermally expand and contract in both radial and axial directions while maintaining concentricity about the rotor axis. That is, the inner shell 14 may expand radially outwardly relative to the outer shell 12 as the inner shell heats up to a predetermined temperature at steady-state operation. Similarly, upon shutdown of the turbine, the inner shell cools and contracts relative to the outer shell. Significantly, with the foregoing-described arrangement of the pins and their configuration, neither radial nor axial loadings are taken up by the pins. Only tangential loadings including aerodynamic loadings are taken up by the pins. Also, the pin arrangement maintains concentricity of the inner shell relative to the outer shell and to the axis of the rotor. Further, because the recesses 50 and 52 are larger in axial dimension than the axial dimension of the projections 66 and the projections are located intermediate the recesses 50 and 52, differential growth of the inner shell in an axial direction, i.e., in thermal response to the operation of the turbine, is not taken up by the support pins.

With the inner shell butting the stage 3 nozzle hanger at its aft end, the inner shell is free for axial thermal expansion in a forward direction. It will be appreciated that the line contact between the circumferential sides of the projections and the walls of the recesses enable radial movement of the inner shell relative to the outer shell and their spacing in fore and aft directions from the end walls of the recesses enables axial thermal growth. A greater axial spacing is provided between the pins and the end faces of the recesses of the forward section of the inner shell than on the aft portion of the inner shell because of the greater differential growth along forward portions of the inner shell.

Figure 14:
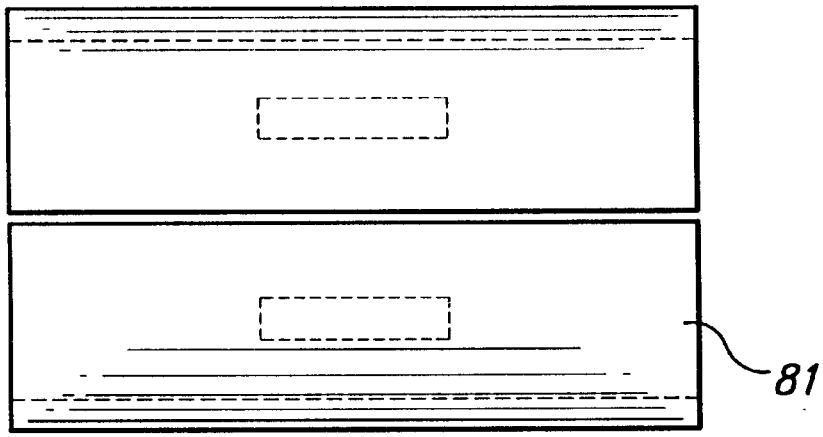
FIGS. 14 and 15 are side and end elevational views, respectively, of a split sleeve for the bolts securing the support pin to the outer shell.
Figure 15:
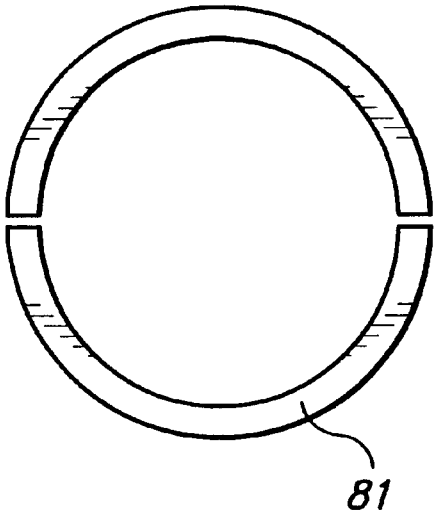

Additionally, and referring to FIGS. 14, 15 and 4, the support pins have shanks which are smaller in diameter than the bolt hole openings to accommodate slight misalignment between the inner and outer shells. The clamping action, therefore, is taken out between the head of the support pin and the underlying flange of the outer shell surrounding the outer shell opening and which receives the bolts of the bolt circle. To assist in preventing the support pin head 60 from moving relative to the outer shell and not rely totally on frictional forces between the support pin and outer shell, a split sleeve 81 which acts like a shear dowel is provided about two or more of the bolts passing through the bolt circle. A split sleeve is illustrated in FIGS. 14 and 15 at 81 and surrounds the shanks of the bolts 83 (FIG. 4) in the bolt circle openings 63, affording higher shear capability. Additionally, hard facing material is welded, preferably by a TIG weld process, to the cylindrical side of the pin head to bear against the stellite bushing, rendering the material at the joint of the support pins and the outer shell extremely hard.

Figure 5:
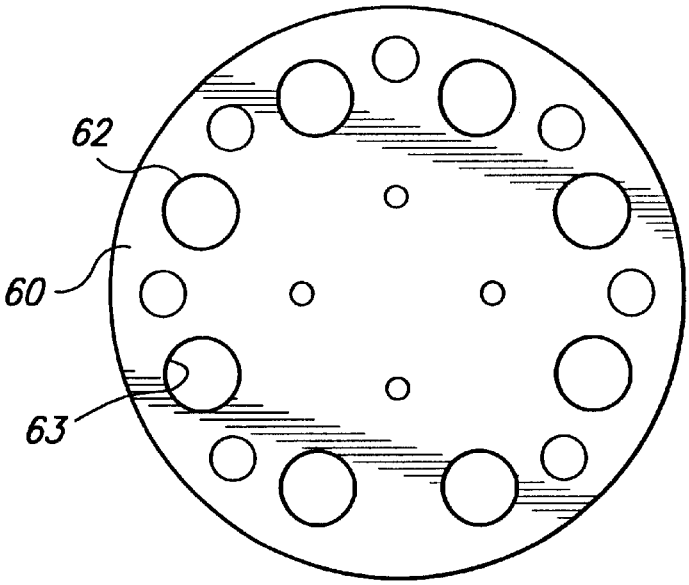
FIGS. 5 and 6 are opposite end views of the support pin.
Figure 6:
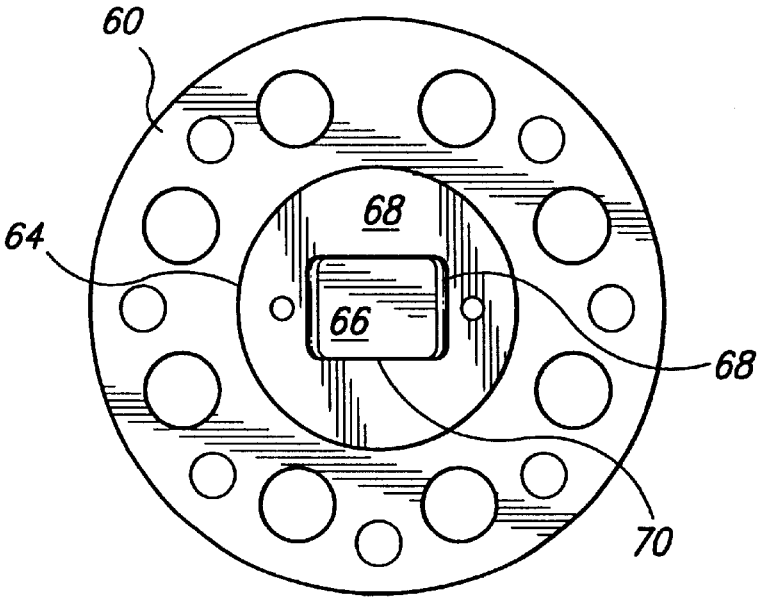
Figure 7:
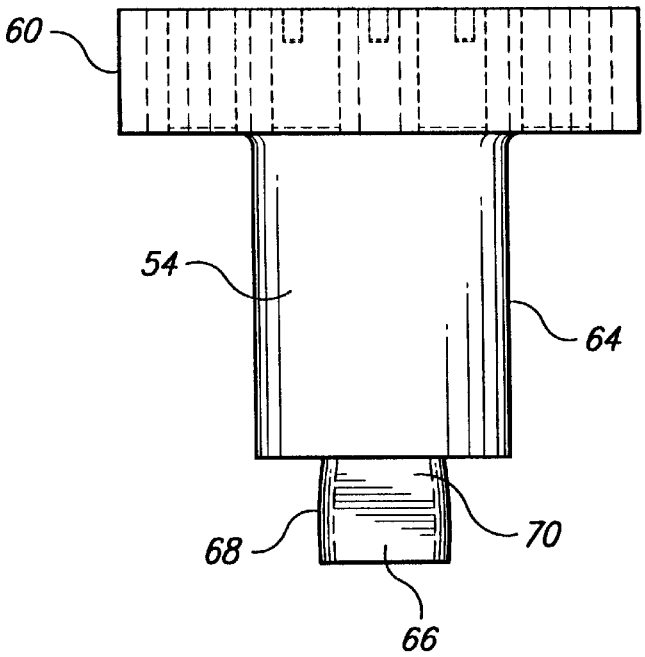
FIGS. 7 and 8 are axial and tangential views of the support pin hereof, respectively.
Figure 8:
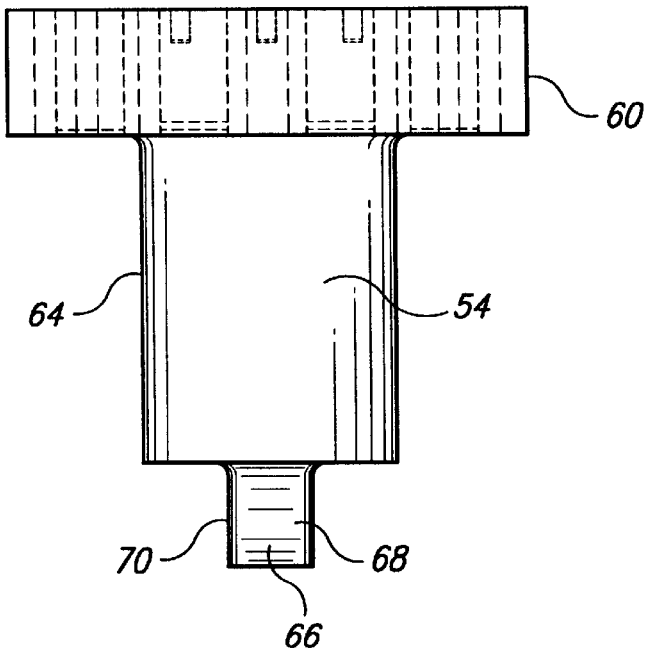

Further, it will be appreciated from a review of FIGS. 5 and 6, that there are a series of offset holes in the bolt head which indicate orientation of the pins upon installation. That is, it is important to orient the pin such that the arcuate sides of the pin projections lie in a radial plane.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine comprising:

an outer structural shell;

an inner shell connected to and surrounded by said outer shell in generally concentric relation therewith, said inner shell carrying nozzles and shrouds for a turbine stage, said shrouds surrounding tips of buckets carried by a turbine rotor within said inner shell;

a plurality of connecting elements engaging between said inner and outer shells aligning said inner shell about the rotor, said connecting elements engaging said inner shell with a clearance in an axial direction of said rotor to enable differential growth of said inner shell relative to said outer shell in an axial direction substantially without loading said elements in the axial direction of the rotor while maintaining concentricity of said inner shell about said rotor.

2. A turbine according to claim 1 wherein said inner shell has a plurality of recesses spaced circumferentially thereabout receiving portions of said connecting elements.

3. A turbine according to claim 1 wherein said connecting elements have circumferentially facing arcuate sides engaging said inner shell along and forming line contacts therewith.

4. A turbine according to claim 1 wherein said connecting elements have circumferential facing side faces each formed by a curve about an axis parallel to the axial direction of said rotor.

5. A turbine according to claim 1 wherein said connecting elements have circumferential facing sides each formed by a surface portion of a cylinder having an axis parallel to the axial direction of said rotor.

6. A turbine according to claim 1 wherein said connecting elements engage said inner shell and carry tangential loads without carrying substantial radial or axial loads.

7. A turbine according to claim 1 wherein the weight of said inner shell and the torque responsive to aerodynamic loadings on said nozzles are carried by said connecting elements as substantially tangential loads without said elements carrying substantial radial or axial loads.

8. A turbine according to claim 1 wherein said inner shell comprises forward and aft shell sections, each of said forward and aft shell sections being engaged by circumferentially spaced connecting elements of said plurality thereof for aligning said inner shell about the rotor.

9. A turbine according to claim 8 wherein the connecting elements connecting between said outer shell and said forward shell section have a greater clearance with said inner shell in an axial direction than a clearance between said connecting elements and said aft inner shell section in said axial direction.

10. A turbine according to claim 1 wherein said inner shell has a plurality of generally rectilinear recesses spaced circumferentially thereabout and opening radially outwardly, said connecting elements including radially inwardly directed projections having generally rectilinear cross-sections for engaging in said recesses, at least one of the long edges of said recess and an adjacent long edge of said projection being spaced from one another in a direction of the axis of the rotor.

11. A turbine according to claim 10 wherein said projections have circumferentially facing arcuate side faces engaging said inner shell and forming line contacts therewith.

12. A turbine according to claim 1 wherein each said connecting element includes a bolt circle having a plurality of bolt openings for receiving bolts for securing said element to said outer shell, at least one of said bolts including a split sleeve thereabout and through a corresponding opening in said bolt circle.

13. A turbine according to claim 1 wherein said inner shell has a plurality of generally circular apertures spaced circumferentially thereabout and opening radially outwardly, generally circular bushings disposed in said circular apertures, each of said bushings having a generally rectilinear opening therein forming said recess for receiving a connecting element.

14. A turbine comprising:

an outer structural shell;

an inner shell connected to and surrounded by said outer shell in generally concentric relation therewith, said inner shell carrying nozzles and shrouds for a turbine stage, said shrouds surrounding tips of buckets carried by an axially extending turbine rotor within said inner shell;

a plurality of connecting elements engaging between said inner and outer shells aligning said inner shell about the rotor, each of said connecting elements including a radial inward projection, said inner shell having a plurality of recesses spaced circumferentially thereabout receiving the projections of said connecting elements;

said inner shell having a plurality of generally circular apertures spaced circumferentially thereabout and opening radially outwardly, generally circular bushings disposed in said circular apertures, each of said bushings having a generally rectilinear opening therein forming said recess for receiving a connecting element.

15. A turbine according to claim 14 wherein said projections engage said inner shell for carrying tangential loads and without carrying substantial radial or axial loads.

16. A turbine according to claim 14 wherein said connecting elements support said inner shell against radial and circumferential movement relative to said outer shell and enable thermal expansion and contraction of said inner shell relative to said outer shell in radial directions.

17. A turbine according to claim 16 wherein said connecting elements comprise support pins supporting said inner shell against radial and circumferential movement relative to said outer shell and enable thermal expansion and contraction of said inner shell relative to said outer shell in radial and axial directions.

18. A turbine comprising:

an outer structural shell;

an inner shell connected to and surrounded by said outer shell in generally concentric relation therewith, said inner shell carrying nozzles and shrouds for a turbine stage, said shrouds surrounding tips of buckets carried by an axially extending turbine rotor within said inner shell;

a plurality of connecting elements engaging between said inner and outer shells aligning said inner shell about the rotor, each of said connecting elements including a radial inward projection, said inner shell having a plurality of recesses spaced circumferentially thereabout receiving the projections of said connecting elements;

said projections having circumferentially facing sides each formed by a curve about an axis generally parallel to the axis of said rotor.

* * * * *